United States Patent [19]

Campbell et al.

[11] Patent Number: 4,739,336

[45] Date of Patent: Apr. 19, 1988

[54] LOG - PERIODIC HF ANTENNA SYSTEM

[75] Inventors: Donn V. Campbell, Poway, Calif.; Palemon W. Dubowicz, Eatontown, N.J.; Bernard Feigenbaum; Kenneth Loffer, both of Neptune, N.J.

[73] Assignee: The United States of America as represented by the Secretary of the Army, Washington, D.C.

[21] Appl. No.: 903,627

[22] Filed: Aug. 28, 1986

[51] Int. Cl.[4] ..... H01Q 11/10

[52] U.S. Cl. ..... 343/792.5; 343/806; 343/825

[58] Field of Search ..... 343/792.5, 806, 825, 343/828

[56] References Cited

U.S. PATENT DOCUMENTS

| | | | |
|---|---|---|---|
| 2,281,429 | 4/1942 | Goddard | 343/806 |
| 2,516,706 | 7/1950 | Laport | 343/806 |
| 3,271,775 | 9/1966 | Yang | 343/792.5 |
| 3,321,764 | 5/1967 | Winegard et al. | 343/793 |
| 4,611,214 | 9/1986 | Campbell et al. | 343/826 |

OTHER PUBLICATIONS

Ben Vester, "The Half Square Antenna", Mar. 1974, pp. 11-14.

Donn V. Campbell et al, Title "Tactical High Frequency Antenna Array".

*Primary Examiner*—William L. Sikes
*Assistant Examiner*—Hoanganh Le
*Attorney, Agent, or Firm*—Sheldon Kanars; Jeremiah G. Murray; John K. Mullarney

[57] ABSTRACT

A plurality of dual feed half square wave antenna element (each of U-shaped configuration) are arranged in a log-periodic structure. The antenna elements are feed at the current loops; i.e., at the corners of the U-shaped antenna elements. A dual inphase feed produces vertical polarization signals of low angle radiation, and a dual antiphase feed produces horizontal polarization signals of high angle radiation.

8 Claims, 14 Drawing Sheets

LOG - PERIODIC HF ANTENNA SYSTEM

The invention described herein may be manufactured, used and licensed by or for the Government for governmental purposes without the payment to us of any royalties thereon.

TECHNICAL FIELD

The present invention relates to the field of radio communication antennas and, more particularly, to a dual feed, dual polarized, log - periodic HF antenna system.

BACKGROUND OF THE INVENTION

Effective high frequency (HF) antennas, which are compatible with the varied and demanding requirements peculiar to military tactical communication, are by no means easily engineered. Military radios operate from 2 to 30 MHz or higher and vary in power from watts to kilowatts. The communication systems are often fixed, but must be transportable by vehicular, man-portable, or airborne means, and may employ ground wave or ionospheric propagation over short, medium or long range paths.

The required mobility would suggest small antenna size, but electrical performance will be compromised if the antenna is made too small in terms of the wavelength(s). The necessary broad frequency range which typically spans four octaves complicates the design of efficient antennas.

The conventional log-periodic antenna generally offers good efficiency and broad bandwidth and has been used heretofore for military communication purposes. A commercially available log-periodic antenna has been utilized as the base station antenna for military communication purposes. While this antenna is satisfactory in the above-mentioned respects, it is unwieldy, difficult and time consuming to deploy, and expensive. Also, it lacks the desired propagation flexibility off-times required by the military.

SUMMARY OF THE INVENTION

It is a primary object of the present invention to achieve a HF antenna design having substantial flexibility in terms of polarization (horizontal, vertical or mixed) and radiation modes (e.g., low-angle or high-angle radiation for long distance or short distance transmission, respectively).

A further object of the invention is to provide an antenna that is light-weight, inexpensive, and easy to deploy.

The foregoing and other objects are achieved in accordance with the principles of the present invention by an antenna comprised of a plurality of dual feed half square antenna elements arranged in a log-periodic structure so as to secure wide bandwidth, propagation flexibility, increase gain, and good directional radiation.

In a preferred embodiment of the present invention a plurality of radiating elements are each comprised of a predetermined gauge wire of U-shaped configuration. The radiating elements are spaced and dimensioned in accordance with log-periodic design parameters for a given operative transmission bandwidth. Each U-shaped element includes a pair of aligned horizontal sections, each of a length equal to one-quarter wavelength ($\lambda/4$) at a predetermined frequency. The pairs of aligned horizontal sections are each separated a short distance by an insulator therebetween. Each horizontal section has a vertical section of the same length ($\lambda/4$) mounted at the end thereof remote from said insulator. The radiating elements are fed at the junctions of the horizontal and vertical sections.

In accordance with a feature of the invention a dual inphase feed induces inphase currents in the vertical sections of the antenna and this achieves vertical polarization for point-to-point transmission, or low angle radiation for long range (1500–4000 kilometer) ionospheric propagation. Alternatively, a dual antiphase (i.e., out-of-phase) feed induces antiphase currents in the verticals of the antenna and this permits horizontal polarization radiation and high angle take-off suitable for short range (800 kilometer) ionospheric paths.

BRIEF DESCRIPTION OF THE DRAWINGS

The invention will be more fully appreciated from the following detailed description when the same is considered in connection with the accompanying drawings in which.

DETAILED DESCRIPTION

Figure 1B:
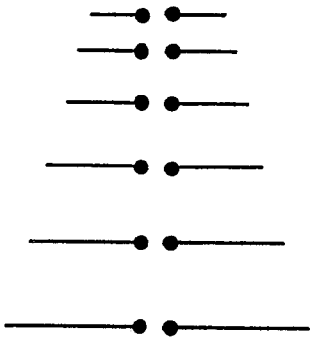
PRIOR ART FIG. 1B
FIGS. 1B and 1C show a prior art log-periodic antenna and the method of feeding the same.
Figure 1A:
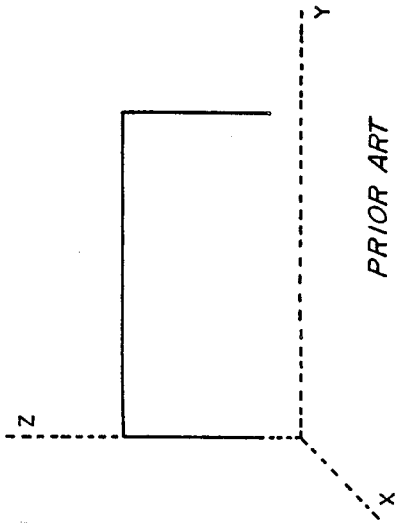
PRIOR ART FIG. 1A
FIG. 1A shows a prior art half square antenna.

Turning now to FIG. 1A of the drawings, there is shown a prior art half square antenna. This antenna consists of a half wave ($\lambda/2$) horizontal wire connected to quarter wave ($\lambda/4$) vertical wires at either end. One of the vertical wires is fed against ground while the opposite end of the antenna is "open circuited" so that it does not connect to ground. This prior art antenna has been disclosed, for example, in an article entitled "The Half Square Antenna" by B. Vester, QST (March) The American Radio Relay League (1974).

Figure 1C:
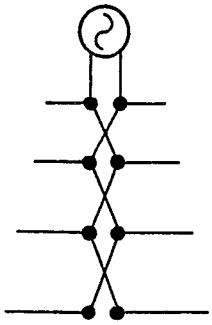
PRIOR ART FIG. 1C

For reasons which will be more evident hereinafter, a conventional log-periodic dipole antenna is shown in FIG. 1B. The geometry and the design of a log-periodic antenna is well known to those skilled in the art; see, for example, "The Electronic Engineer's Handbook," 2nd Edition, by D. G. Fink et al, McGraw-Hill Book Co. (1982). As is known, a log-periodic antenna is an antenna having a structural geometry such that its impedance and radiation characteristics repeat periodically as the logarithm of frequency. The log-periodic is typically fed in the manner illustrated in FIG. 1C, the feed line usually comprising a balanced line.

The known method-of-moments technique was used to determine the performance of the antennas discussed herein. The solutions were obtained using the Mini-Numerical Electromagnetics Code (MININEC) and the Numerical Electromagnetics Code (NEC). These codes provide numerical solutions for the antenna currents from which all of the significant antenna properties, such as impedance and radiation patterns, can be computed. These codes or programs have the capability of including ground effects. MININEC is a very small code written in BASIC which can be run on a desk top computer. The NEC program is written in FORTRAN and requires a larger computer. In effect, the antenna concepts were simulated using these codes or programs; see, for example, "Microcomputer Tools for Communications Engineering" by S. T. Li et al, Artech House Inc. (1983). These codes, of course, have little to do with the present invention and only serve for theoretical analysis purposes.

Figure 2:
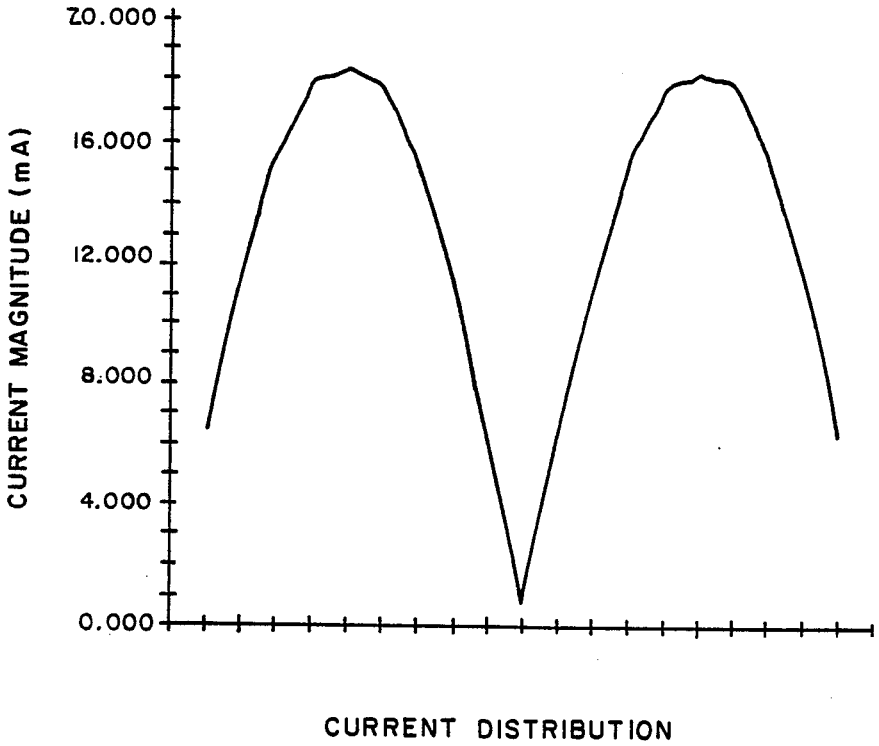
FIG. 2 shows the current distribution for the half square antenna of FIG. 1A.

The current distribution on the half square antenna of FIG. 1A corresponds to that of a full wave antenna having a current node at its midpoint and current loops a quarter wave from each end, as shown in FIG. 2. Thus, the current loops are located at the junctions of the horizontal and vertical sections. This distribution causes the currents in the vertical sections or wires to be inphase and the radiation to be bidirectional and broadside to the antenna. The E-field polarization is predominately vertical.

Figure 3:
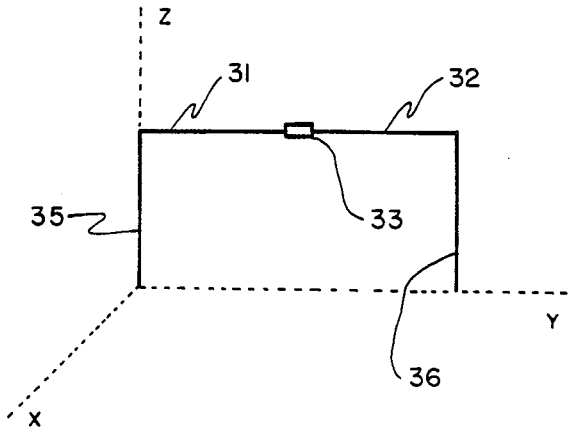
FIG. 3 shows a dual feed half square antenna in accordance with the present invention.

Now in accordance with the present invention, a second feed is added to the half square antenna and the two feeds are located at the current loops. The antenna can then be excited in two different modes, one favoring low-angle radiation and the other high-angle radiation. By feeding at a current loop, a low impedance is obtained which is compatible with the impedance of standard cable transmission lines. Current coupling from one half of the antenna to the other is eliminated by cutting the horizontal wire at its midpoint and inserting an insulator, such as a standard ceramic insulator. This separation also reduces the effects of minor structural unsymmetries. An antenna incorporating these novel features is shown in FIG. 3 of the drawing. The antenna of FIG. 3 comprises a pair of aligned horizontal sections 31 and 32, each of a length equal to one-quarter wavelength ($\lambda/4$). The aligned horizontal sections are separated a short distance by an insulator 33. Each horizontal section has a vertical section 35, 36 of the same length ($\lambda/4$) at the end thereof remote from the insulator. The antenna element of FIG. 3 is the basic element utilized in constructing the dual feed, dual polarized, log-periodic HF antenna to be discussed hereinafter.

Figure 4:
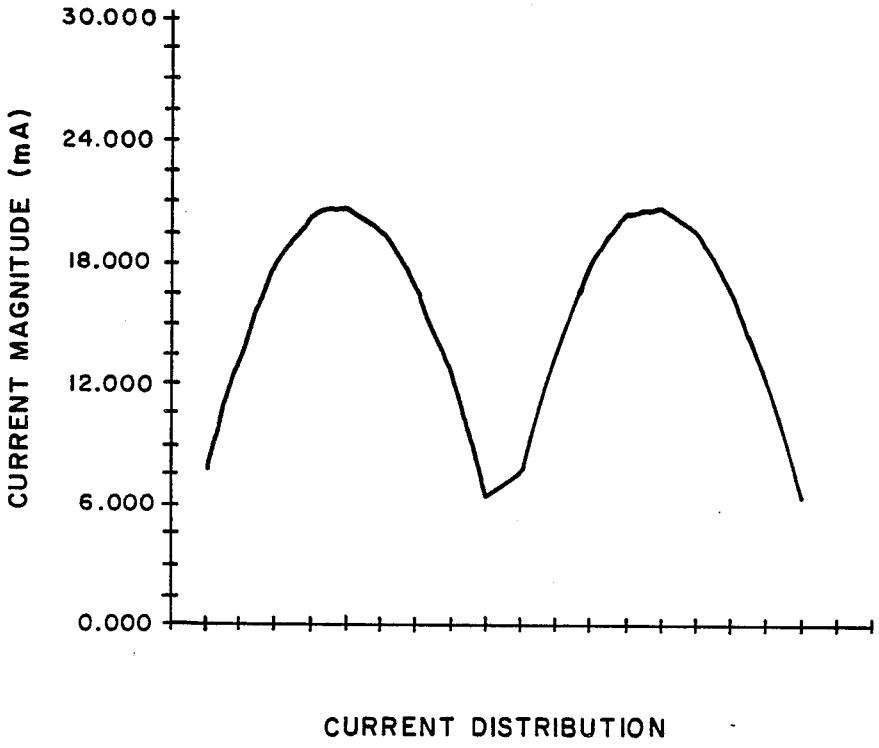
FIG. 4 shows the current distribution for the dual feed half square wave antenna of FIG. 3 for inphase feed.

When the exciting voltages cause the currents in the vertical sections or wires 35 and 36 to be inphase, the dual feed half square wave antenna of the invention will then perform essentially the same as the single feed antenna of FIG. 1A. The calculated current distribution of this antenna is shown in FIG. 4.

Figure 5:
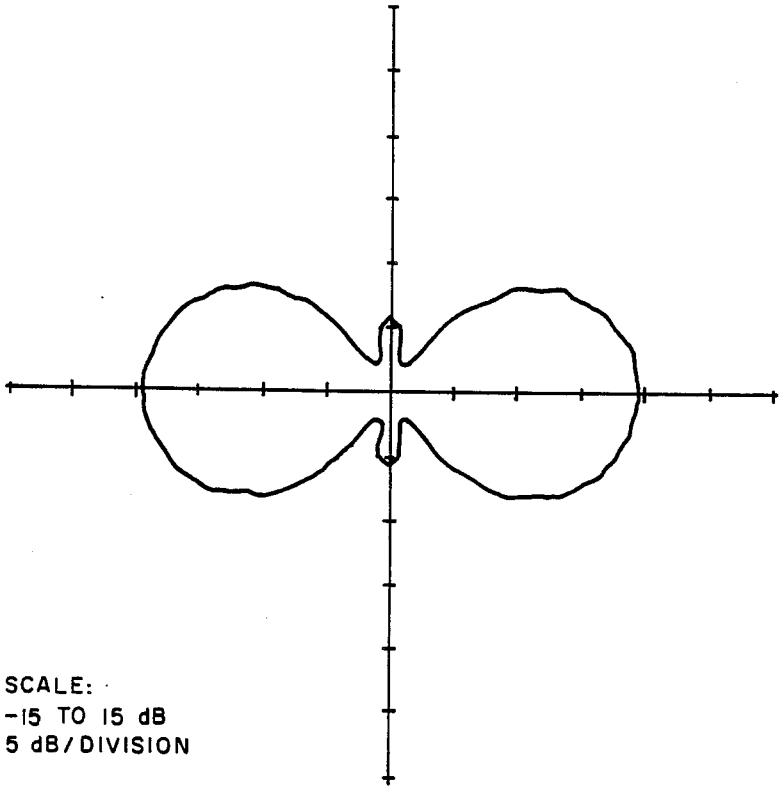
FIGS. 5 and 6 show calculated azimuthal and elevation gain patterns for the dual feed half square wave antenna for the inphase excitation mode.
Figure 6:
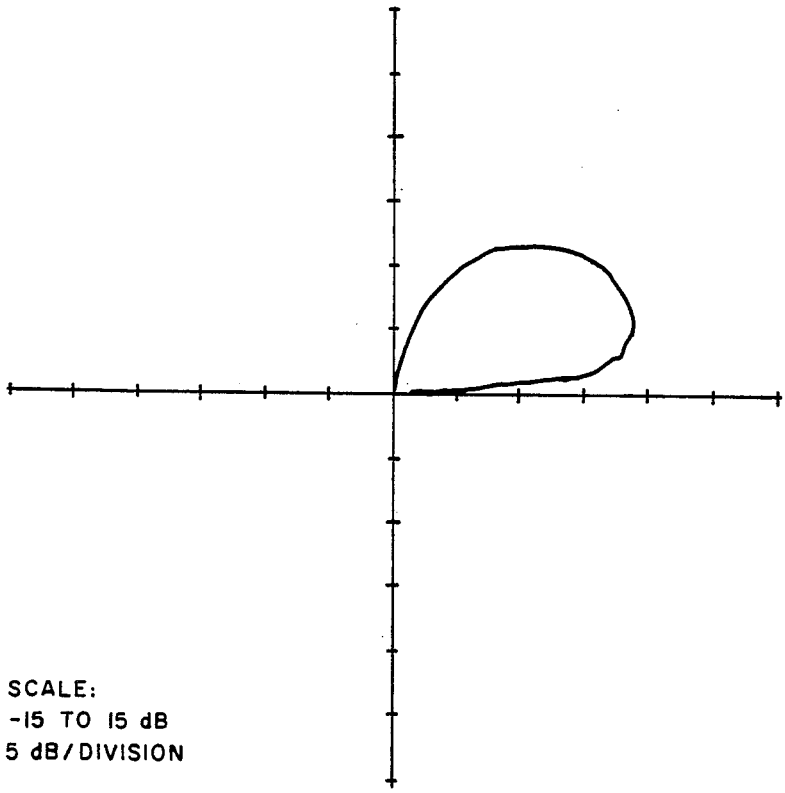

The calculated azimuthal and elevation gain patterns for inphase excitation of the FIG. 3 antenna are shown in FIGS. 5 and 6. The elevation pattern (FIG. 6) shows that this antenna is a good low-angle radiator and therefore desirable for medium and/or long range (1500–4000 kilometer) ionspheric paths.

Figure 7:
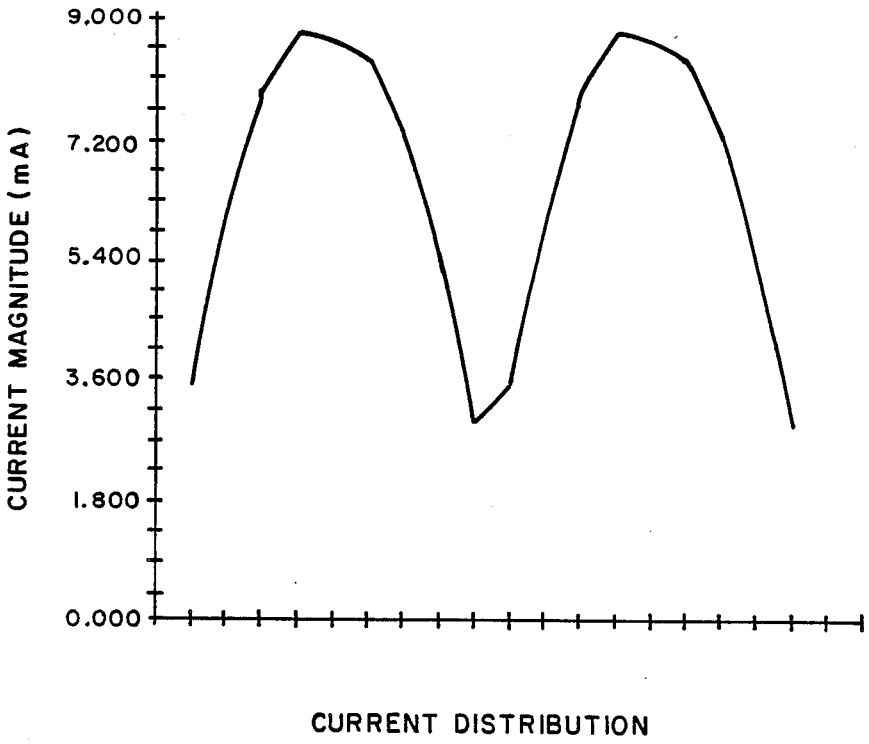
FIG. 7 shows the current distribution for the dual feed half square antenna of FIG. 3 for antiphase feed.

When the two feeds are excited so that the vertical wire currents are antiphase (out-of-phase), the antenna of the invention will then favor high-angle radiation and horizontal polarization. The calculated current distribution is shown in FIG. 7.

Figure 8:
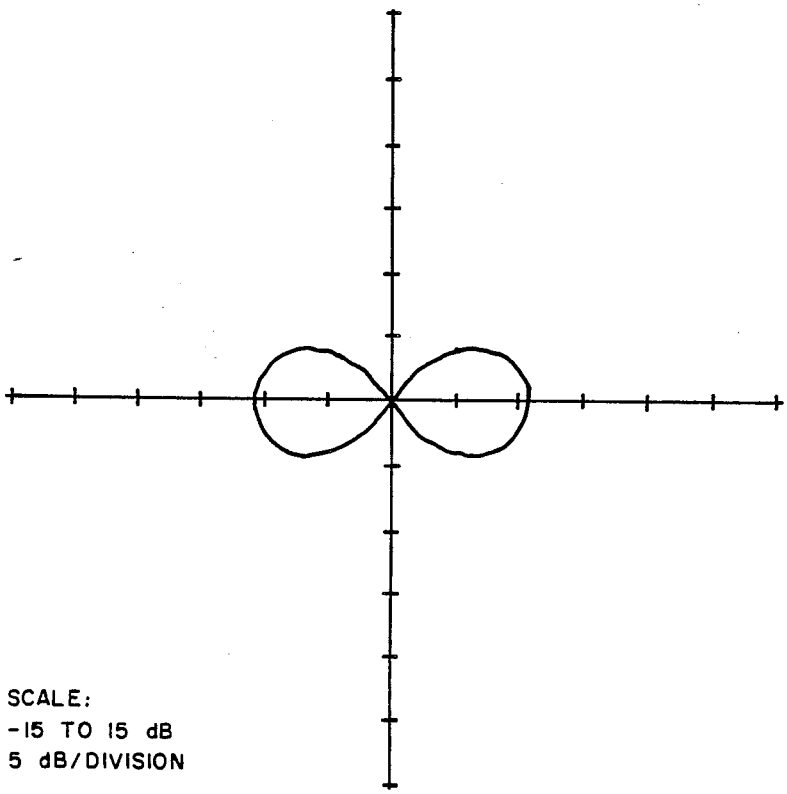
FIGS. 8 and 9 show calculated azimuthal and elevation gain patterns for the dual feed half square antenna for the antiphase excitation mode.
Figure 9:
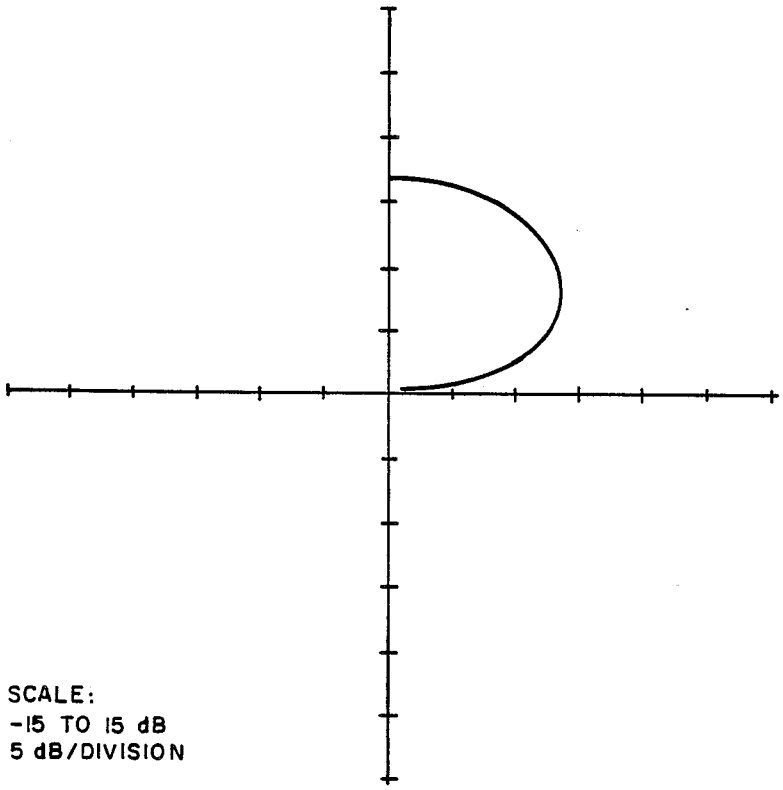

The calculated azimuthal and elevation gain patterns for the antiphase excitation of the FIG. 3 antenna are shown in FIGS. 8 and 9. The elevation pattern (FIG. 9) indicates that this antenna radiates effectively at high take-off angles when excited antiphase. High take-off angle radiation is desirable for short range (e.g., 800 kilometers) ionospheric paths.

Figure 10:
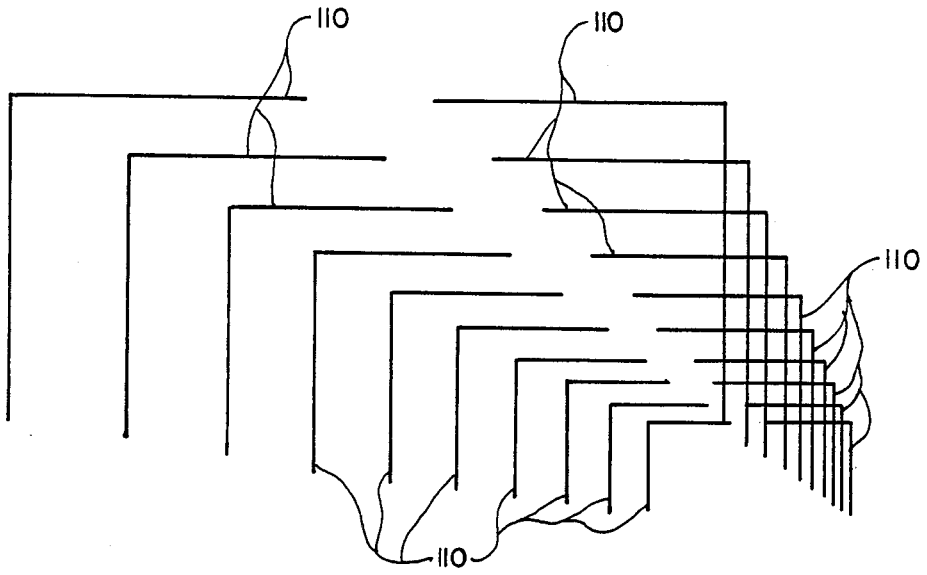
FIG. 10 shows a dual feed, dual polarized, log-periodic antenna in accordance with the invention.

The dual feed half square antenna of FIG. 3 is incorporated in a log-periodic structure to secure increased gain, wide bandwidth, increased radiation flexibility, and good directional radiation. This log-periodic antenna in accordance with the present invention is shown in FIG. 10. This antenna is comprised of a plurality of dual feed half square antenna elements 110 dimensioned in accordance with standard log-periodic design procedures well known to those skilled in the art. The insulators between the horizontal sections have not been shown in FIG. 10 to keep this showing simple. The dimensional parameters of the horizontal and vertical sections of the half square elements 110 (in terms of wavelength) have been set forth above.

Figure 11:
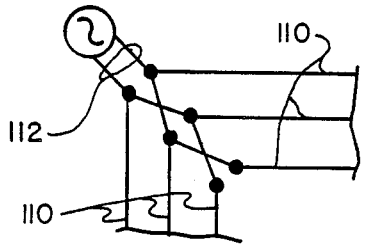
FIG. 11 illustrates a method of feeding the antenna of FIG. 10.

The plurality of half square antenna elements 110 are fed at the current loops; i.e. at the pair of junctions of the horizontal and vertical sections, in the manner suggested in FIG. 11. The transmission feed line 112 alternates in its connections to the horizontal and vertical sections of elements 110. This is a typical method of feeding log-periodic dipole antennas; see for example, the above-cited "Electronics Engineer's Handbook", FIGS. 18–36.

Looking at a dual feed half square antenna element (e.g. FIG. 3) in a different and perhaps alternative fashion, it should be apparent to those in the art that the two halves thereof are each somewhat equivalent to a conventional dipole antenna with center feed. Thus, the dual feed half square antenna may be considered akin to two dipoles. The sections 31 and 35 together (FIG. 3) are similar to a conventional dipole with center feed, and the same is also true for sections 32 and 36. However, unlike a standard dipole that has two aligned sections of $\lambda/4$ each, the sections 31 and 35 are perpendicular to each other. In most other respects, the similarity holds true.

An experimental 15 element, half square, log-periodic antenna was constructed to cover the upper two octaves of the high frequency range. This antenna was designed to operate from 8 to 30 MHz. The antenna was composed of half square elements made of No. 14 gauge wire and was supported by two lightweight aluminum 40 foot masts. The antenna height decreased to 4 feet at the shortest element. Another pair of lightweight masts were located at the short end and a pair of transmission lines were strung from the high to the short masts. The horizontal sections of the antenna elements strung between the transmission lines in accordance with log-periodic design dictates. Thus, the transmission lines provided the requisite support, as well as the feed for the antenna elements. The ends of the vertical sections of the antenna elements were tied down by ropes to prevent any wind induced motion. It is to be understood, however, that the manner in which the antenna of the present invention is mounted has little to do with the invention and other and different mounting arrangements will readily occur to those in the art.

Figure 12:
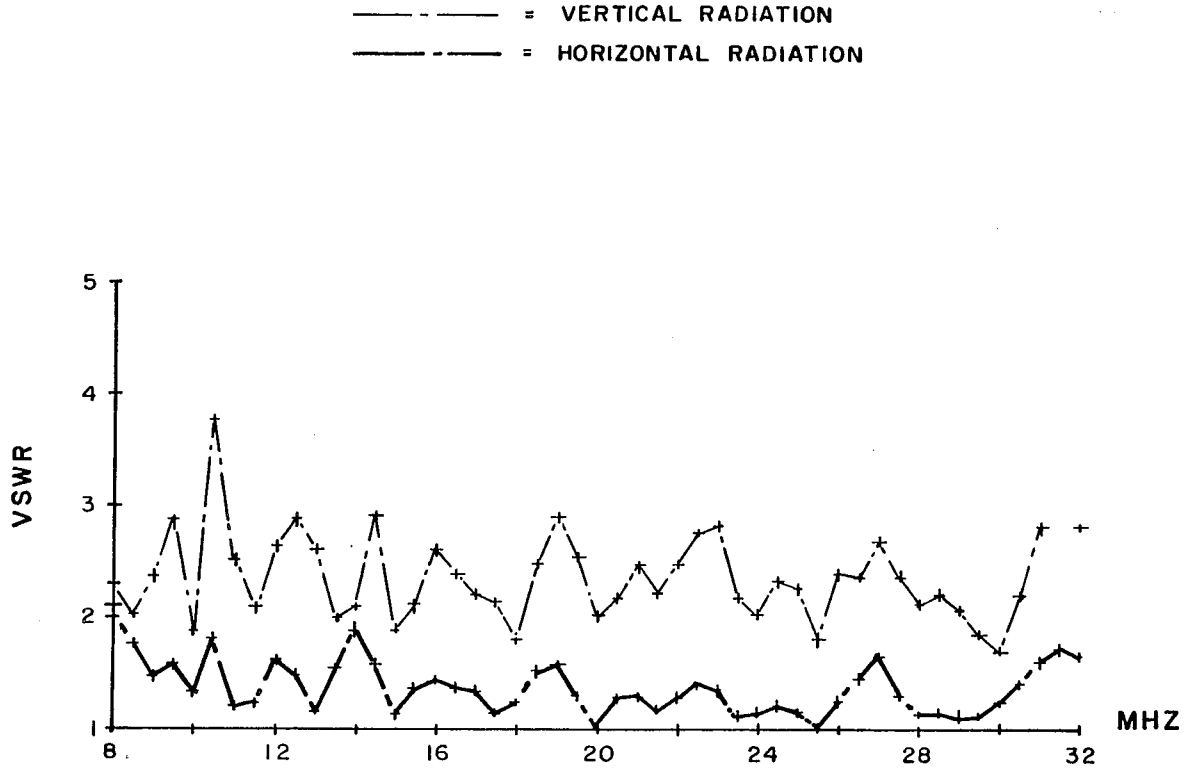
FIG. 12 shows measured VSWR for an experimental dual feed log-periodic antenna.
Figure 13:
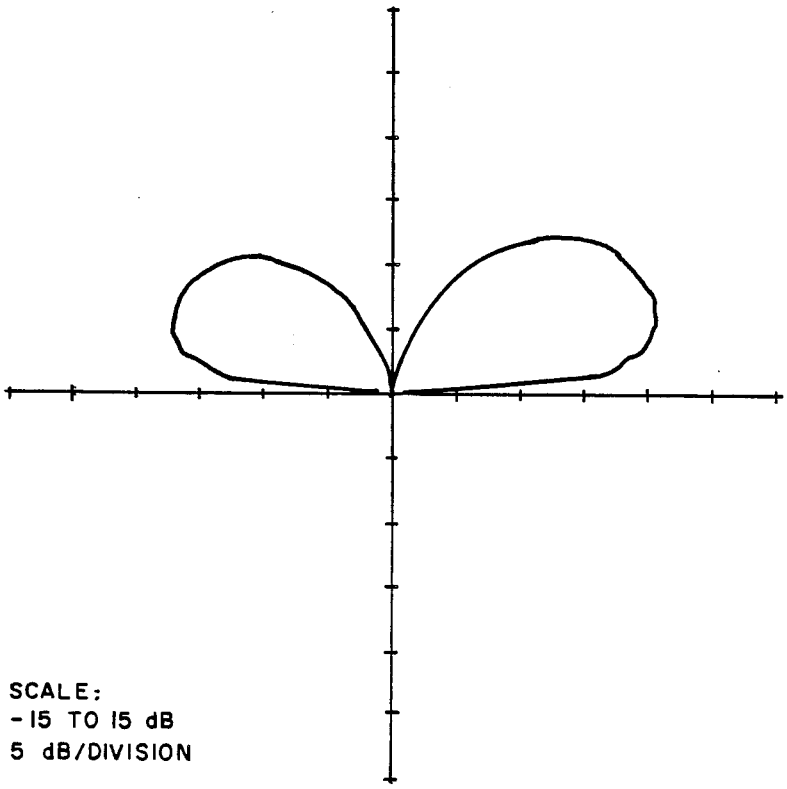
FIG. 13 shows the calculated elevation pattern for the inphase mode of excitation of the dual feed log-periodic antenna.
Figure 14:
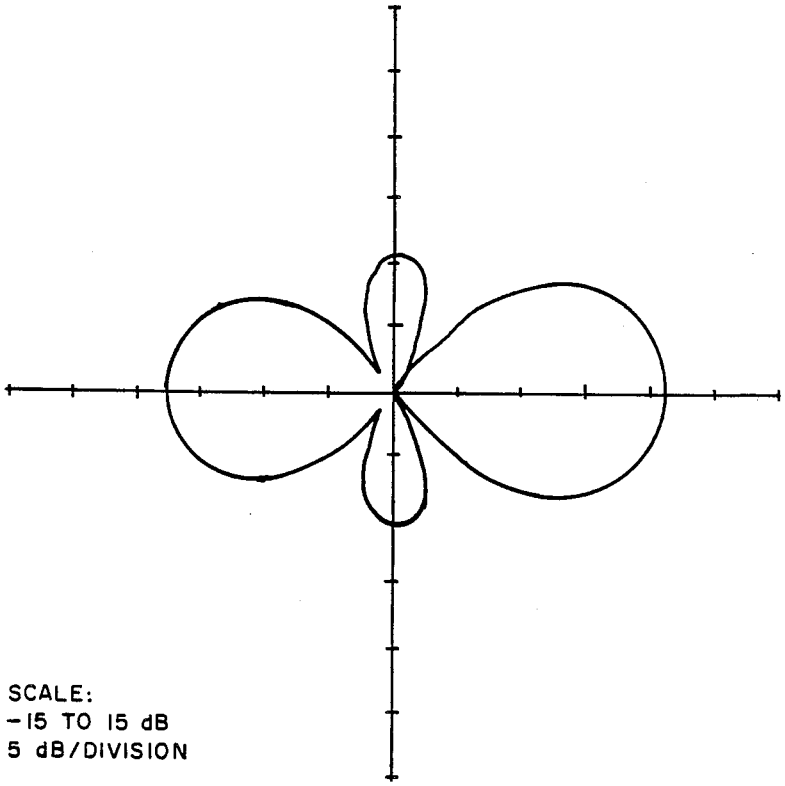
FIG. 14 shows the calculated azimuthal pattern for the inphase mode of excitation of the dual feed log-periodic antenna.
Figure 15:
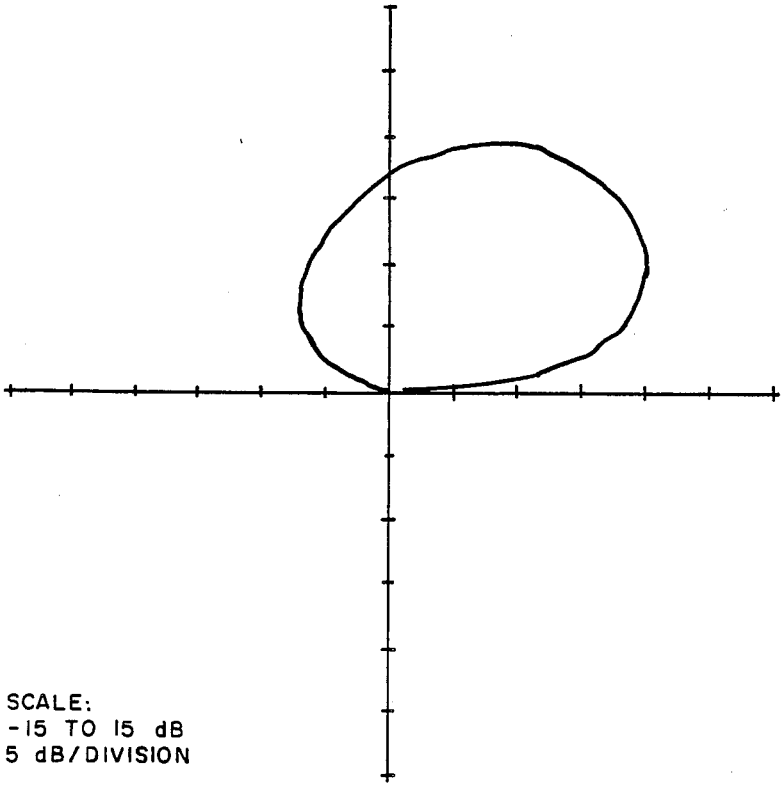
FIG. 15 shows the calculated elevation pattern for the antiphase mode of excitation of the log-periodic antenna.
Figure 16:
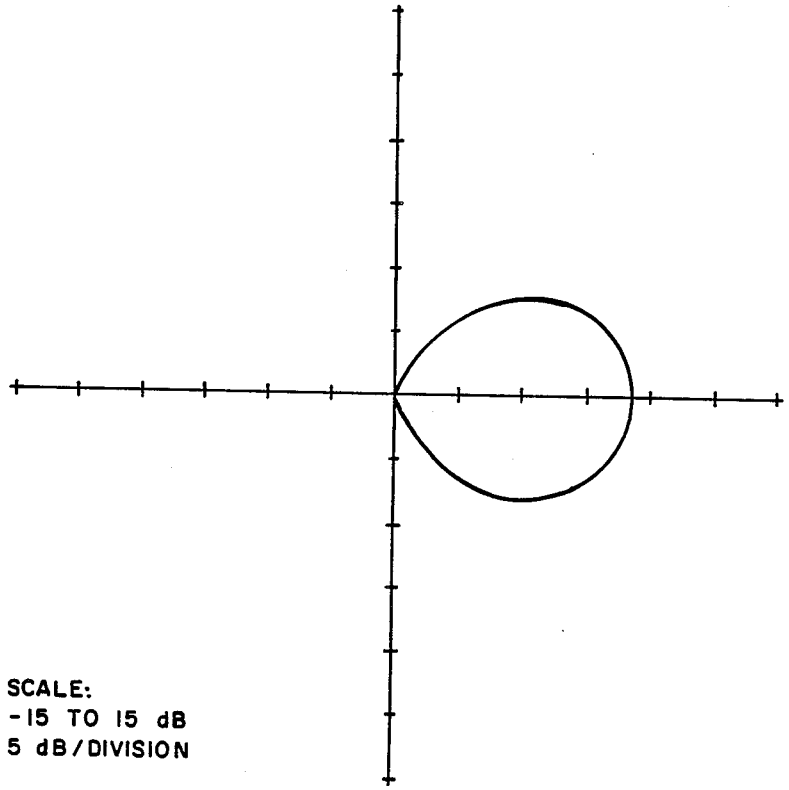
FIG. 16 shows the calculated azimuthal pattern for the antiphase mode of excitation of the dual feed log-periodic antenna.

The measured voltage standing wave ratio (VSWR) of the experimental dual feed log-periodic antenna between 8 and 32 MHz is given in FIG. 12. This measurement confirms the broadband impedance behavior of this antenna for both modes of excitation. For this test the antenna was fitted with a 50 ohm combiner and a pair of four-to-one impedance matching transformers. The slight aberration in the VSWR radiation at approximately 10.5 MHz is unexplainably, but it is believed that it can be readily corrected for by minor antenna element adjustment.

A computer model of the dual feed log-periodic antenna was investigated; i.e., the antenna was computer simulated. The computer model was based on the dimensions used in the experimental antenna, described above, but only the ten shortest elements were included to reduce computer time. The calculated radiation patterns at 10 MHz for both modes of excitation are given in FIGS. 13–16. In general the patterns indicate that the antenna radiates effectively at low angles when excited in the inphase mode and at high angles when excited in the antiphase mode. Similar patterns have been calculated at 8 MHz and at 15 MHz. It is likely that the radiation patterns will not change significantly up to 30 MHz.

With respect to the illustrated radiation patterns, it will be clear to those in the art that with minor adjustments, modifications, and experimentations in spacing, section lengths, etc. the log-periodic antenna of the invention should provide improved transmission characteristics; i.e., reduced side lobes, reduced backward propagation, etc.

The dual feed capability of the antenna of the present invention lends itself to polarization diversity reception, since the antenna is equally useful for transmission or reception purposes. While a specific embodiment of the invention has been described in detail, it is to be understood that numerous modifications and variations therein may be devised by those skilled in the art without departing from the spirit and scope of the invention.

What is claimed is:

1. A broadband antenna system comprising a plurality of radiating element means each of predetermined gauge wire and of U-shaped configuration, said radiating means being spaced and dimensioned in accordance with log-periodic design parameters for a given transmission bandwidth, each U-shaped element means having a pair of aligned horizontal sections each of a length equal to one-quarter wavelength ($\lambda/4$) at a predetermined frequency, said pair of sections being separated a short distance by an insulator therebetween, each horizontal section having a vertical section of the same length mounted at the end thereof remote from said insulator, and feed means for each element means located at both of the junctions at said horizontal and vertical sections.

2. An antenna system as defined in claim 1 wherein said feed means induces inphase currents in said vertical sections.

3. An antenna system as defined in claim 1 wherein said feed means induces antiphase or out-of-phase currents in said vertical sections.

4. An antenna system as defined in claim 1 wherein said radiating element means are enabled by said feed means to produce horizontally polarized signals.

5. An antenna system as defined in claim 1 wherein said radiating element means are enabled by said feed means to produce vertically polarized signals.

6. An antenna system as defined in claim 1 wherein said radiating element means are enabled by said feed means to produce low angle radiation.

7. An antenna system as defined in claim 1 wherein said radiating element means are enabled by said feed means to produce high angle radiation.

8. An antenna system as defined in claim 1 wherein said predetermined wire is number 14 gauge wire.

* * * * *